US006977317B1

(12) United States Patent
Frey et al.

(10) Patent No.: US 6,977,317 B1
(45) Date of Patent: Dec. 20, 2005

(54) PROCESS FOR THE SELECTIVE HYDROGENATION OF OLEFINS

(75) Inventors: Stanley J. Frey, Palatine, IL (US); Richard E. Marinangeli, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 420 days.

(21) Appl. No.: 10/180,737

(22) Filed: Jun. 25, 2002

(51) Int. Cl.[7] ..... C07C 5/03; C07C 5/05
(52) U.S. Cl. ..... 585/258; 585/259
(58) Field of Search ..... 585/258, 259

(56) References Cited

U.S. PATENT DOCUMENTS 3,670,041 A * 6/1972 Juhl et al. ..... 585/258
5,417,844 A 5/1995 Boitiax et al. ..... 208/143

* cited by examiner

*Primary Examiner*—Thuan D Dang
(74) *Attorney, Agent, or Firm*—John G. Tolomei; James C. Paschall; John G. Cutts, Jr.

(57) ABSTRACT

A process for the selective hydrogenation of olefins contained in a hydrocarbonaceous feedstock comprising olefins and aromatic compounds.

11 Claims, No Drawings

PROCESS FOR THE SELECTIVE HYDROGENATION OF OLEFINS

BACKGROUND OF THE INVENTION

The field of art to which this invention pertains is the selective hydrogenation of olefins contained in a hydrocarbon stream comprising olefins and aromatic compounds. Hydrogenation processes have been used by petroleum refiners and petrochemical producers to produce more valuable hydrocarbonaceous products. Hydrocarbonaceous streams containing olefins and aromatic compounds are only useful if the olefins can be selectively hydrogenated without the simultaneous hydrogenation of the aromatic compounds. Previously, selective hydrogenation has been performed with a supported catalyst containing metals including those of Group VIII with particular reference to nickel. However, nickel catalysts are not sufficiently selective because they have a marked tendency to hydrogenate a significant part of the aromatic compounds when selectively hydrogenating olefins. The selectivity is not satisfactorily improved even when the hydrogenation operations are performed at low pressures of approximately 30 to 50 bar and at low temperatures between 50° C. (22° F.) and 180° C. (356° F.). The prior art has taught that the selectivity of these catalysts can be improved by injecting sulfur compounds prior to the contacting of the catalyst and the reactive feedstock.

Although a wide variety of process flow schemes, operating conditions and catalysts have been used in the selective hydrogenation of olefinic hydrocarbons, there is always a demand for new selective hydrogenation methods which provide lower costs and the required product quality.

INFORMATION DISCLOSURE

U.S. Pat. No. 5,417,844 B1 (Boitiaux et al) discloses a process for the selective hydrogenation of diolefins in steam cracking petrol in the presence of a nickel catalyst and is characterized in that prior to the use of the catalyst, a sulfur-containing organic compound is incorporated into the catalyst outside of the reactor prior to use.

BRIEF SUMMARY OF THE INVENTION

The present invention is an improved process for the selective saturation of olefins in a hydrocarbonaceous stream containing olefins and aromatic compounds without significant hydrogenation of the aromatic compounds. It has been unexpectedly discovered that when the feedstock is reacted with an elemental nickel catalyst at relatively low temperatures and a low stoichiometric ratio of hydrogen to olefins, the selective saturation of olefins is high with low hydrogenation of the aromatic compounds.

In accordance with one embodiment, the present invention relates to a process for the selective hydrogenation of olefins contained in a hydrocarbonaceous feedstock comprising olefins and aromatic compounds which process comprises the steps of: (a) reacting the hydrocarbonaceous feedstock with hydrogen in a selective hydrogenation zone containing a catalyst comprising elemental nickel at olefin hydrogenation conditions including a temperature from about 20° C. (68° F.) to about 200° C. (392° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds and having a reduced concentration of olefins.

In accordance with another embodiment, the present invention is a process for the selective hydrogenation of olefins contained in a hydrocarbonaceous feedstock comprising olefins in an amount from about 0.02 to about 5 weight percent and aromatic compounds which process comprises the steps of: (a) reacting the hydrocarbonaceous feedstock with hydrogen in a selective hydrogenation zone containing a catalyst comprising elemental nickel at olefin hydrogenation conditions including a temperature from about 20° C. (68° F.) to about 200° C. (392° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds and having an olefin concentration of less than about 0.2 weight percent olefins.

In another embodiment, the present invention relates to a process for the selective hydrogenation of olefins contained in a hydrocarbonaceous feedstock boiling in the naphtha range comprising olefins in an amount from about 0.02 to about 5 weight percent and aromatic compounds which process comprises the steps of: (a) reacting the hydrocarbonaceous feedstock with hydrogen in a selective hydrogenation zone containing a catalyst comprising elemental nickel at olefin hydrogenation conditions including a temperature from about 20° C. (68° F.) to about 200° C. (392° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds and having an olefin concentration of less than about 0.02 weight percent olefins.

Other embodiments of the present invention encompass further details such as types and descriptions of feedstocks, hydrogenation catalysts and preferred operating conditions including temperatures and pressures, all of which are hereinafter disclosed in the following discussion of each of these facets of the invention.

DETAILED DESCRIPTION OF THE INVENTION

It has been discovered that improved selective hydrogenation of olefins may be achieved by reacting a hydrocarbonaceous feedstock containing olefins and aromatic compounds with a catalyst comprising elemental nickel at mild operating conditions and a limited stoichiometric ratio of hydrogen to olefins.

Although the present invention is particularly useful for the selective hydrogenation of olefins contained in naphtha boiling range hydrocarbonaceous streams, any suitable hydrocarbonaceous feedstock may be used in the present invention. A preferred feedstock is a naphtha boiling in the range from 38° C. (100° F.) to about 204° C. (400° F.) and containing olefins in an amount from about 0.1 to about 5 weight percent.

In accordance with the present invention, the hydrocarbonaceous feedstock containing olefins and aromatic compounds is introduced along with hydrogen into a selective hydrogenation zone containing a selective hydrogenation catalyst comprising elemental nickel and operated at selective hydrogenation conditions including a temperature from about 20° C. (68° F.) to about 200° C. (392° F.), a pressure from about 618 kPa (75 psig) to about 7000 kPa (1000 psig) and a stoichiometric ratio of hydrogen to olefins from about 1:1 to about 5:1. A more preferred hydrogenation zone temperature is from about 20° C. (68° F.) to about 50° C. (122° F.).

Suitable selective hydrogenation catalysts in the present invention contain elemental nickel preferably supported on a high surface area support material, preferably alumina. In the case where the elemental nickel is present on a support, the nickel is preferably present in an amount from about 2 to about 40 weight percent of the total catalyst weight.

Hydrocarbonaceous streams, which contain aromatic compounds and olefins, are utilized in downstream processing wherein the presence of olefins is detrimental to the catalysts used in subsequent processing or is undesirable in product streams. Therefore, it is preferred and desirable that when such hydrocarbon streams are used, the olefins are selectively saturated while preventing or at least minimizing the saturation of the aromatic compounds. Suitable hydrocarbonaceous streams may be derived from any source and a common source for such a hydrocarbonaceous stream is the liquid effluent from a catalytic reformer processing a naphtha feedstock. In the case of a catalytic reformer effluent stream, the aromatic compounds are valuable while the co-produced olefins are considered to be contaminants, which must be removed while preserving the aromatic compounds. The present selective hydrogenation process can be employed to reduce the concentration of olefins in a hydrocarbonaceous feedstock containing aromatic compounds and olefins.

Accordingly, a process is presented for the selective hydrogenation of olefins comprising contacting a feed containing aromatic compounds and olefins in a reaction zone at selective hydrogenation conditions with a catalyst comprising elemental nickel to produce a product substantially free of olefinic compounds. The selective hydrogenation conditions include a temperature from about 20° C. (68° F.) to about 200° C. (392° F.), a pressure from about 618 kPa (75 psig) to about 7000 kPa (1000 psig) and a stoichiometric ratio of hydrogen to olefins from about 1:1 to about 5:1. The optimum set of conditions will be selected from these conditions and depend on the composition of the feed steam. In any event, the product from the selective hydrogenation reaction zone will be substantially free of olefins. The term "substantially free" means less than 1000 wppm weight basis of the olefinic compounds (0.1 weight percent). In addition, it is preferred that less than 0.5 weight percent of the aromatic compounds in the hydrocarbonaceous feedstock are hydrogenated.

According to the present invention, the selective hydrogenation catalyst is preferably employed in a fixed bed reactor containing a cylindrical bed of catalyst through which the reactants move in a vertical direction. The catalyst may be present within the reactor as pellets, spheres, extrudates, or irregular shaped granules, for example. To employ the catalyst, the reactants would be preferably brought up to the desired inlet temperature of the reaction zone, admixed with hydrogen and then passed into and through the reactor.

Alternatively, the reactants may be admixed with the desired amount of hydrogen and then heated to the desired inlet temperature. In either case, the effluent of the reaction zone may be passed into a product recovery facility for the removal of residual hydrogen or may be passed directly into downstream product utilization zones if the presence of residual hydrogen, if any, is acceptable. Hydrogen may be removed by flashing the effluent stream to a lower pressure or by passing the effluent stream into a stripping or a single stage flash column.

The preferred form of the catalyst is spheres having a diameter between about 0.4 mm (1/64 inch) and 6.3 mm (1/4 inch). Spheres of solid catalyst support material can be made in a number of different ways including rolling and compaction techniques. However, it is greatly preferred that spherical alumina particles be utilized as the catalyst support and formed by a method for effecting gelation of an alumina sol. This method of gelation of alumina to form spheres is commonly known in the art as the oil drop method. The alumina sol may be also formed a number of different ways. A typical one is to digest aluminum metal with an aqueous solution of approximately 12 percent hydrogen chloride to produce an aluminum chloride sol. Another method comprises electrolysis of a solution of aluminum chloride in an electrolytic cell. A common method of preparing an alumina sol is the addition of aluminum metal to an aqueous solution of aluminum chloride with this mixture being subjected to heating and digesting at its boiling point.

A preferred method for effecting the gelation of the sol comprises the steps of admixing the sol with a gelling agent at a temperature below the gelation temperature and then dispersing the resulting admixture as droplets in the hot oil bath whereby gelation occurs with the formation of firm spherical gel particles. The alumina hydrogel spheres are then subjected to certain aging treatments in order to impart the desired physical characteristics. Generally, a complete aging treatment comprises aging in hot oil for a period of at least 10 hours, aging in a suitable liquid alkaline medium at least 10 hours and finally washing with water to reduce the concentration of alkaline medium. In such a process for the forming and aging of alumina particles, the hydrogel spheres are not to be contacted with water prior to being aged in the liquid alkaline medium. The spheres are water-soluble at these earlier stages of the process and can be destroyed upon contact with water. The aging treatment may be effected at a temperature from about 49° C. to about 260° C. and above about 100° C. there exists a tendency for the rapid evolution of gases which cause the hydrogel spheres to rupture and otherwise become weak. By maintaining a superatmospheric pressure during the forming and aging step, higher temperatures may be employed for aging. The utilization of higher temperatures offers such advantages as the elimination of aging in a liquid alkaline solution. The spheres may therefore be washed with water immediately following the oil aging step. Typically, gelled particles are aged in the oil bath for a time from about 1 to about 24 hours at a temperature from about 90° C. to about 150° C. and a pressure ranging from atmospheric to about 1000 kPa. If oil aged under atmospheric pressure conditions, the gelled particles are generally further aged in a dilute aqueous ammoniacal solution for 2 to 4 hours. After being aged, the particles are water washed, dried and calcined.

The gelation of the alumina hydrosol may be effected by admixing the sol with hexamethylenetetramine (HMT), a weak base having a strong buffering action at a pH of from about 4 to about 10. This material also has an increased rate of hydrolysis at increased temperature without a sudden evolution of gas which is advantageous in the gelation procedure. It is also known that a mixture of urea and HMT may be employed as the gelling agent. Upon heating the mixture to an elevated temperature, the gelling agent decomposes and forms ammonia which causes the hydrosol to set to a gel and permits forming alumina hydrogel spheres. Following gelation and aging, the particles may be oven dried at 110° C. and then heated gradually to about 650° C. and calcined in air at this temperature for 2 hours. The resultant material after the air calcination is essentially gamma alumina. What is meant by the term "essentially" is that the resultant alumina support be comprised of at least 90 weight percent gamma alumina. To ensure that the support material be essentially gamma alumina, it is highly desirable that the support material not be exposed to a temperature in excess of 850° C. Exposure to temperatures in excess of 850° C. will result in a phase change of the alumina, converting it from the gamma- to delta-, theta-, and possibly even alpha-alumina. Such a phase change is usually accompanied by a collapse of the small pores (less than 100 angstroms) creating larger pores which results in an increase in total pore volume. However, because the surface area is directly proportional to the quantity and pore size of the small pores, the collapse of these pores results in a dramatic drop in surface area of the support material. Therefore, by utilizing the oil drop method, it is possible to form a gamma alumina support material having a total pore volume greater than 1.4 cc/g with a surface area in excess of 150 $m^2/g$, thus avoiding the attendant problems just described associated with alternative forming techniques.

Besides the basic alumina support material, an elemental nickel is required for the performance of the catalyst used in the present invention. The nickel may be present only on the outer surface of the alumina support material or uniformly throughout the support. Having the nickel on the outer surface of the support means that the nickel is surface-deposited, such that, essentially all of the nickel present on the support is concentrated within the outermost 200 micron layer of the support. The concentration of nickel in the finished catalyst is preferably between 5 and 25 weight percent, on the basis of the elemental metal. The nickel component can be added to the catalyst during the sphere formation procedure if it is so desired. However, it is preferred that the nickel component of the catalyst is added to the previously formed alumina spheres as by impregnation in which the formed alumina spheres are immersed into a solution of a nickel compound. Preferably, the formed calcined alumina spheres are immersed in an aqueous solution of nickel nitrate, nickel chloride, nickel sulfate or nickel acetate or other water-soluble nickel compound. The solution is then preferably evaporated to dryness in contact with the spheres utilizing a rotary steam evaporator. The dried particles may then be calcined at a temperature of about 150° C. for one hour and then at about 525° C. for one hour. The formed spheres may then be dried and purged with nitrogen and are preferably subjected to a reduction step in contact with a hydrogen-containing gas. Although spherical alumina spheres are the preferred support for the nickel component of the catalyst, any suitable support may be utilized in the present invention.

The process of the present invention is further demonstrated by the following examples. These examples are not presented to unduly limit the process of this invention, but to further illustrate the advantage of the hereinabove-described embodiment.

EXAMPLE I

A model feedstock containing 99 weight percent toluene and 1 weight percent $C_6$–$C_8$ olefinic hydrocarbons was reacted in a selective hydrogenation reaction zone containing elemental nickel on a gamma alumina support operated at selective hydrogenation conditions including a pressure of 5600 kPa (800 psig), a temperature of 40° C. (104° F.), a liquid hourly space velocity of 10, and a hydrogen to olefin mole ratio of 1.5. The Bromine Index, which is a direct relationship of the olefin content, of the feedstock was 1000 and an analysis of the effluent from the selective hydrogenation reaction zone determined that the product Bromine Index was only 20. While essentially converting all of the feedstock olefins, only less than 0.2 weight percent of the toluene in the feedstock was saturated.

EXAMPLE 2

A model feedstock containing 99 weight percent toluene and 1 weight percent $C_6$–$C_8$ olefinic hydrocarbons was reacted in a selective hydrogenation reaction zone containing elemental nickel on a gamma alumina support operated at a pressure of 5600 kPa (800 psig), a liquid hourly space velocity of 10 and a hydrogen to olefin mole ratio of 1.5. The hydrogenation reaction was started by increasing the reaction zone temperature to 90° C. (194° F.) and the Bromine Index of the product stream was found to be about 150. Without changing any other operating conditions, the reaction zone temperature was reduced from 90° C. (194° F.) to 50° C. (122° F.) and the Bromine Index was unexpectedly reduced from 150 to about 40. A further reduction in the reaction zone temperature from 50° C. (122° F.) to 40° C. (104° F.) reduced the Bromine Index from 40 to about 20. In this example, only less than 0.2 weight percent of the toluene in the feedstock was saturated.

The foregoing description and examples clearly illustrate the advantages encompassed by the process of the present invention and the benefits to be afforded with the use thereof.

What is claimed is:

1. A process for the selective hydrogenation of olefins contained in a hydrocarbonaceous feedstock comprising olefins and aromatic compounds which process comprises the steps of:

(a) reacting the hydrocarbonaceous feedstock with hydrogen in a selective hydrogenation zone containing a catalyst comprising elemental nickel and an alumina support at olefin hydrogenation conditions including a temperature from about 20° C. (68° F.) to about 50° C. (122° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds having a reduced concentration of olefins and containing less than 0.5 weight percent hydrogenated aromatic compounds.

2. The process of claim 1 wherein the hydrocarbonaceous feedstock is a naphtha boiling range stream.

3. The process of claim 1 wherein the feedstock contains olefins in an amount from about 0.02 to about 5 weight percent.

4. The process of claim 1 wherein the hydrocarbonaceous product stream contains less than about 0.1 weight percent olefins.

5. The process of claim 1 wherein the catalyst is spherical.

6. The process of claim 1 wherein the catalyst contains nickel in an amount from about 2 to about 40 weight percent of the total catalyst weight.

7. A process for the selective hydrogenation of olefins contained in a hydrocarbonaceous feedstock comprising olefins in an amount from about 0.02 to about 5 weight percent and aromatic compounds which process comprises the steps of:

(a) reacting the hydrocarbonaceous feedstock with hydrogen in a selective hydrogenation zone containing a catalyst comprising elemental nickel and an alumina support at olefin hydrogenation conditions including a temperature from about 20° C. (68° F.) to about 50° C. (122° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds having an olefin concentration of less than about 0.1 weight percent olefins and containing less than 0.5 weight percent hydrogenated aromatic compounds.

8. The process of claim 7 wherein the hydrocarbonaceous feedstock is a naphtha boiling range stream.

9. The process of claim 7 wherein the catalyst contains nickel in an amount from about 2 to about 40 weight percent of the total catalyst weight.

10. A process for the selective hydrogenation of olefins contained in a hydrocarbonaceous feedstock boiling in the naphtha range comprising olefins in an amount from about 0.02 to about 5 weight percent and aromatic compounds which process comprises the steps of:

(a) reacting the hydrocarbonaceous feedstock with hydrogen in a selective hydrogenation zone containing a catalyst comprising elemental nickel and an alumina support at olefin hydrogenation conditions including a temperature from about 20° C. (68° F.) to about 50° C. (122° F.), a pressure from about 618 kPa (75 psig) to about 7000 kPa (1000 psig) and a stoichiometric ratio of hydrogen to olefins from about 1:1 to about 5:1; and (b) recovering a hydrocarbonaceous product stream comprising aromatic compounds having an olefin concentration of less than about 0.1 weight percent olefins and containing less than 0.5 weight percent hydrogenated aromatic compounds.

11. The process of claim 10 wherein the catalyst contains nickel in an amount from about 2 to about 40 weight percent of the total catalyst weight.

* * * * *